US006726039B2

(12) United States Patent
Boron

(10) Patent No.: US 6,726,039 B2
(45) Date of Patent: Apr. 27, 2004

(54) INVENTORY CONTROL SYSTEM FOR WALK-IN DISPLAY COOLERS AND THE LIKE

(75) Inventor: Andrew J. Boron, Belleville, IL (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 10/064,553

(22) Filed: Jul. 25, 2002

(65) Prior Publication Data

US 2002/0166830 A1 Nov. 14, 2002

Related U.S. Application Data

(63) Continuation-in-part of application No. 09/814,207, filed on Mar. 21, 2001, now Pat. No. 6,474,484.

(51) Int. Cl.[7] ..... A47F 5/00

(52) U.S. Cl. ..... 211/162; 211/187; 108/107; 312/201

(58) Field of Search ..... 211/162, 187, 211/191, 90.02, 94.01, 175, 151, 59.2; 312/201, 198, 301; 108/107

(56) References Cited

U.S. PATENT DOCUMENTS

| | | | | |
|---|---|---|---|---|
| 1,424,284 A | * | 8/1922 | Dyke | |
| 2,098,828 A | | 11/1937 | Ludwick | |
| 2,274,908 A | * | 3/1942 | Murray | |
| 2,685,491 A | | 8/1954 | Bulow | |
| 3,561,608 A | | 2/1971 | Weider | 211/176 |
| 3,570,682 A | | 3/1971 | Elliott | 211/126 |
| 3,625,372 A | * | 12/1971 | MacKenzie | |
| 3,846,944 A | * | 11/1974 | Lambert | |
| 4,106,630 A | * | 8/1978 | Rosenband | 211/191 |
| 4,270,661 A | | 6/1981 | Rosenband | 211/162 |
| 4,292,902 A | | 10/1981 | Barrineau | 211/187 X |
| 4,789,210 A | * | 12/1988 | Weiss et al. | 312/201 |
| 4,807,765 A | | 2/1989 | Brown et al. | |
| 4,898,283 A | | 2/1990 | Kingsford | 211/162 X |
| 4,972,783 A | | 11/1990 | Crissman et al. | 108/107 |
| 5,004,304 A | | 4/1991 | Segerpalm et al. | 312/201 |
| 5,072,838 A | | 12/1991 | Price, Jr. et al. | |
| 5,205,627 A | | 4/1993 | Davison et al. | |
| 5,265,739 A | | 11/1993 | Price, Jr. et al. | |
| 5,490,600 A | | 2/1996 | Bustos | |
| 5,597,217 A | * | 1/1997 | Hoska et al. | 312/201 |
| 5,749,481 A | | 5/1998 | Miller | 211/187 X |
| 5,943,967 A | | 8/1999 | Sherman | |
| 6,112,917 A | | 9/2000 | Baker et al. | 211/162 |
| 6,158,600 A | | 12/2000 | Ferrucci et al. | 211/90.02 |
| 6,158,601 A | * | 12/2000 | Baker et al. | 211/162 |
| 6,474,484 B1 | * | 11/2002 | Miller | 211/162 |

OTHER PUBLICATIONS

New Generation Boltless Shelving, Aug. 28, 1999, Manufactured by E–Z–Rect Manufacturing, Ltd., Printed in Canada.

* cited by examiner

*Primary Examiner*—Robert W. Gibson, Jr.
(74) *Attorney, Agent, or Firm*—Blackwell Sanders Peper Martin LLP

(57) ABSTRACT

A product inventory control system is provided that utilizes both fixed and movable racks. The present system may be utilized in a walk-in display cooler or other product storage application to help with inventory management and to provide easy access to stored product. The racks of the present system include shelf support members that are selectively positionable at a plurality of different orientations so as to achieve different product support surface orientations relative to a horizontal The shelf support members are adapted for storing a plurality of different types of products and product containers. Movable racks are positioned in front of fixed racks whereby movement of a movable rack provides access to a rack positioned therebehind.

11 Claims, 16 Drawing Sheets

INVENTORY CONTROL SYSTEM FOR WALK-IN DISPLAY COOLERS AND THE LIKE

CROSS REFERENCE TO RELATED APPLICATIONS

This application is a continuation-in-part of U.S. application Ser. No. 09/814,207 filed Mar. 21, 2001, now U.S. Pat. No. 6,474,484 entitled INVENTORY CONTROL SYSTEM FOR WALK-IN DISPLAY COOLERS AND THE LIKE.

BACKGROUND OF INVENTION

Walk-in product merchandising display coolers are commonly used in retail outlets such as convenience stores and grocery stores to display a wide variety of different types of products to the consumer. A walk-in cooler typically includes one or more consumer access doors that open into the store area to allow a consumer access to products from display racks and associated shelving positioned adjacent the access doors. Such walk-in display coolers also typically include a storage area located behind the display racks which permits both the storage of product to be ultimately placed on the display racks and provides room for employees to fill the display racks from the rear with products stored within the storage area of the cooler.

Products stored in such coolers include bottled and canned beverages which are heavy, cumbersome and have "use-by" dates which need to be honored in order to provide fresh product to the consumer. Typically, product is stored in the cooler storage area by stacking multiple layers of containerized product on the floor or on fixed position racks or pallets. Storage racks provided in such coolers are fixed both with respect to the floor surface and with respect to the individual shelves associated with the racks. In other words, the racks themselves are non-movable and the individual shelves associated therewith are typically fixed at one orientation and are not capable of being adjustably positionable into more than one orientation such as a horizontal orientation and a gravity feed orientation. Such storage systems can result in a first-in/last-out mode of operation which means consumers could be sold out-of-date product or fresher product first while older product remains buried at the bottom of the stack. Also, the depth (front-to-rear) of the stacks of product is limited because access to rear positioned stacks is inhibited by front positioned stacks whether the stacks are positioned on the floor or on fixed racks or pallets.

Complicating the problem of product storage in walk-in type coolers or other storage space holding areas is the fact that walk-in display coolers tend to have limited storage space therein. This limited space makes it difficult for employees to work and maneuver within the cooler thereby adversely affecting worker efficiency.

Movable storage rack systems are known in the art. Such systems have one or more racks or shelving systems moveably mounted generally on guides (tracks) and such racks or shelving systems can be moved from side to side to provide access to racks or shelving systems located behind the moving rack(s). Such systems can include several racks positioned in spaced apart relationship from front to back with the back rack usually being fixed and non-movable. Examples of such systems can be found in U.S. Pat. Nos. 5,205,627; 5,943,967; 5,265,739; 5,072,838; and 4,087,765. These patents disclose movable shelving units or racks that move on wheels along upwardly opening tracks such as upwardly opening grooves or on angle member tracks. If an object were to lie or become wedged in the upwardly opening groove, such object might derail the shelving unit during movement thereby causing damage to product and potentially injuring workers. Further, to protect against tipping over, many of the disclosed racks utilize a retention system positioned at the top of the shelves. The shelving system disclosed in U.S. Pat. No. 5,205,627 utilizes an upwardly opening groove for a track and a complicated bottom mounted anti-tip device that has a large profile and is not compact. None of the known shelving systems provide shelf members which are selectively positionable at a plurality of different angular orientations for different product support arrangements and none are adaptable for use as a product inventory control system as hereinafter described.

Thus, there is a need for an improved walk-in display cooler system which includes an inventory control system that will permit a first-in/first-out mode of operation for re-stocking product and that can utilize the limited space in the storage area of the cooler more efficiently.

Accordingly, the present invention is directed to overcoming one or more of the problems as set forth above.

SUMMARY OF INVENTION

The present invention relates to a movable inventory control rack for use in a walk-in display cooler or other product storage area, the present inventory control system providing for a first-in/first-out method of handling inventory in the cooler or other product storage area. The present rack system can include a plurality of movable racks and a plurality of fixed racks whereby movement of one or more movable racks provides access to racks located behind a movable rack. The rack system includes floor mounted tracks which guide support wheels mounted adjacent the bottom of the movable rack. Each rack, whether movable or fixed, includes a plurality of upright support structures adaptable for holding and supporting a plurality of shelves or product holding trays therebetween, each shelf or tray being supported by a pair of horizontally disposed front and rear shelf support members which are selectively attachable to elongated posts associated with the upright support structures. The front and rear shelf support members and the upright support structures are provided with cooperating attachment elements for mounting the shelf support members between the upright structures in various orientations whereby a shelf or product holding tray or container can be positioned to hold and store products at different angles relative to the floor surface.

Other objects and features will be in part apparent and in part pointed out hereinafter.

BRIEF DESCRIPTION OF DRAWINGS

For a better understanding of the present invention, reference may be made to the accompanying drawings.

Corresponding reference characters indicate corresponding parts throughout the several views of the drawings.

DETAILED DESCRIPTION

Although the present rack system will be described with respect to use in a typical walk-in display cooler environment, its use is not so limited and it is recognized and anticipated that the present system will be utilized in a wide variety of different applications as will be hereinafter evident.

Figure 1:
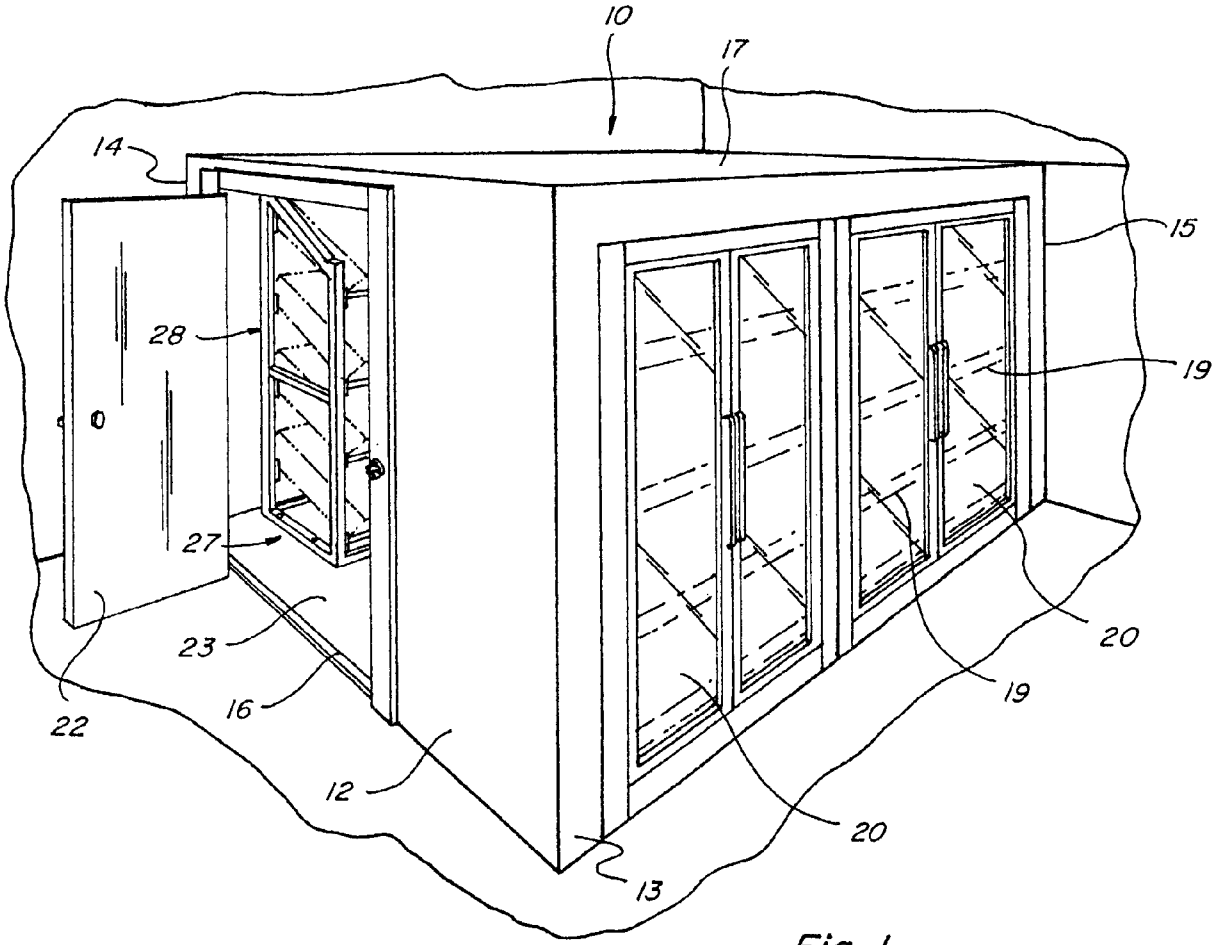
FIG. 1 is a perspective view of a walk-in display cooler having an entry door open to show a portion of the interior of the cooler.
Figure 2:
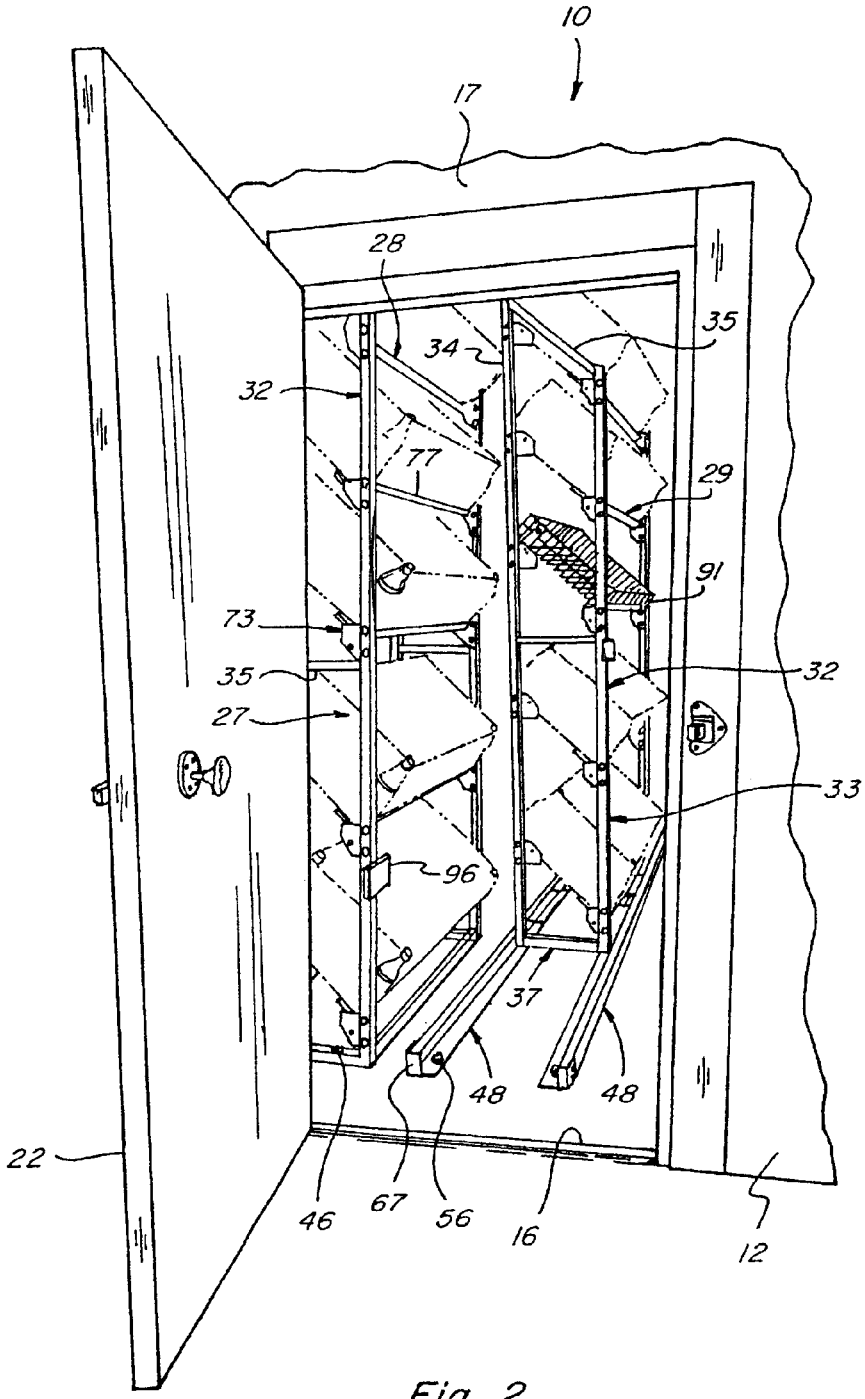
FIG. 2 is a fragmentary view of the cooler and rack system of FIG. 1 enlarged to show additional detail.

A typical walk-in cooler, as best illustrated in FIGS. 1 and 2, includes side walls 12, 13, 14 and 15, a floor 16, and a roof 17. The cooler 10 further includes a plurality of display racks 19 positioned at the front of the cooler adjacent to one or more customer access doors 20 associated with the front wall 13. The display racks 19 are used to hold and display product such as food items and beverages. The display racks 19 are filled by a worker from the rear of the respective racks while working inside the cooler 10. Typically, at least some of the shelves associated with the display racks 19 are inclined or sloped downwardly toward the doors 20 in a gravity feed orientation so that the products positioned and displayed thereon are self-feeding under the influence of gravity to the front of the display racks 19 for easy access through the cooler doors 20. The cooler 10 is also provided with an access door 22 for ingress and egress of a worker into and out of the interior 23 of the cooler 10 for both storing product within the cooler and for stocking and re-stocking the display racks 19. The above described cooler is of a type well-known in the art and can be found in a wide variety of retail outlets such as supermarkets, convenience stores, gas stations, grocery stores and the like.

A rack system designated generally 27 is provided in the interior 23 of the cooler 10 and preferably includes one or more fixed, non-movable racks 28 and one or more movable racks 29 positioned in front of the fixed racks 28. Although only two rows of racks 28 and 29 are illustrated, it is recognized and anticipated that any suitable number of racks can be provided. In a particularly preferred embodiment, only the back row of racks 28 is fixed in position and is generally positioned adjacent a cooler wall to save space. The movable racks 29 are constructed to provide for lateral movement (side-to-side) in either direction. When access is needed to one rack behind another rack, the rack in the front is moved to the side providing access to a rack therebehind.

Figure 5:
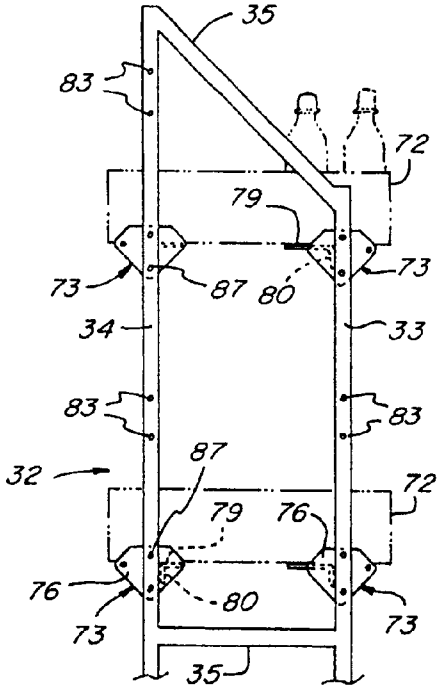
FIG. 5 is a fragmentary end view of one rack of the present system showing attachment of the front and rear shelf support members to the upright support structures with a product holding tray in position to form generally horizontal shelves.
Figure 6:
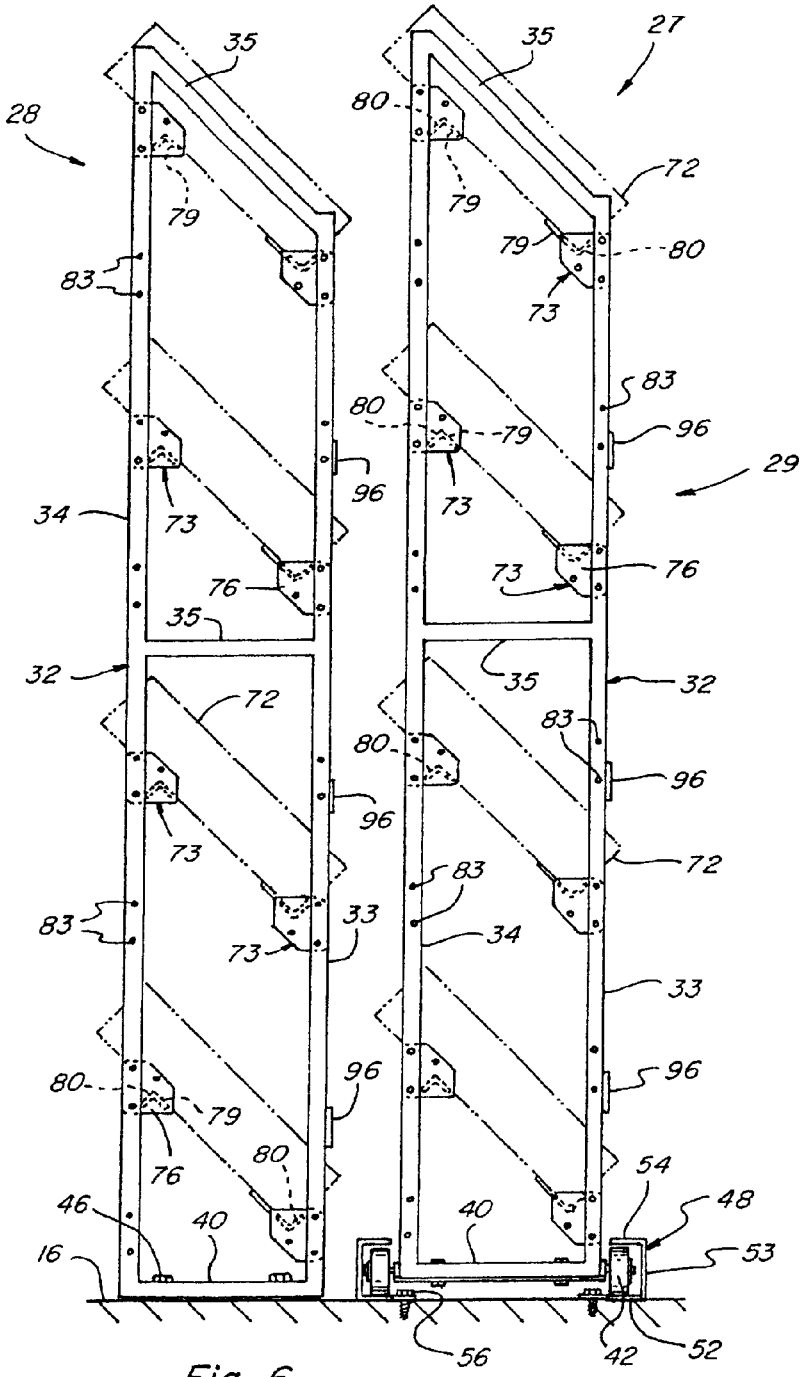
FIG. 6 is an end view of two rows of racks of the present system showing attachment of the front and rear shelf support members to the upright support structures in position to form downwardly sloping shelves.
Figure 9:
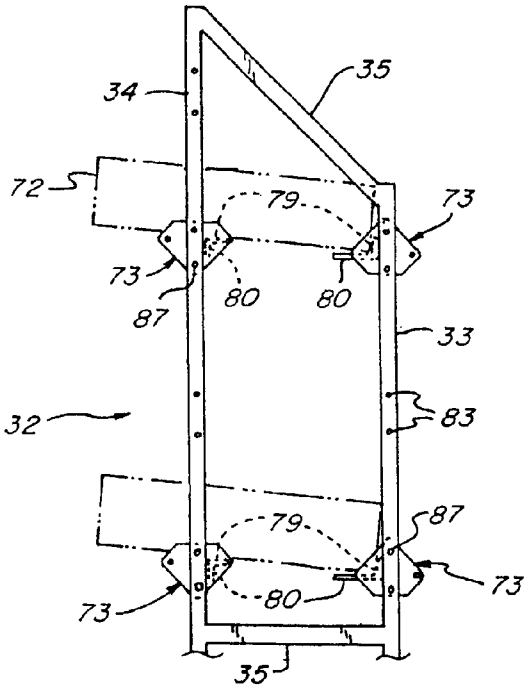
FIG. 9 is an enlarged fragmentary end view of racks showing the shelf support members in position to form a generally horizontal shelf with a front upturned lip.

For manufacturing convenience, the racks 28 and 29 are similar in construction and are comprised of a pair of spaced apart upright support structures 32 located at each opposite end of the respective racks 28 and 29 as illustrated in FIGS. 2, 5, 6 and 9, each upright structure 32 being generally vertical and parallel to one another. In the illustrated structure, each upright support structure 32 includes spaced front and back posts 33 and 34 respectively, or other equivalent upright elongated members, and one or more cross brace members 35 secured between a pair of front and back posts 33 and 34 to help rigidify the overall structure 32. As shown in FIGS. 5, 6 and 9, the top most brace member 35 is placed at an angle between front and rear posts 33 and 34 while the mid-brace member 35 can be positioned generally perpendicular to the post members 33 and 34. In this regard, it is recognized that any number of cross brace members 35 can be utilized to rigidify the overall upright structure 32 and that the brace members can be positioned and oriented in any manner between the front and rear posts 33 and 34 so long as rigidity is achieved.

Each pair of upright support structures 32 is fixedly secured to a base frame member 37 as best illustrated in FIG.

14. The base frame 37 includes front and rear brace members 39 and end brace members 40 that are secured together forming a generally rectangular base frame. In a preferred embodiment, the upright support structures 32 and base frame 37 are welded together to form an integral structure. It is also preferred that the upright post members 33 and 34 and brace members 39 and 40 be of rectangular or square tubing. Likewise, cross brace members 35 may be of similar tubing and welded to the respective posts 33 and 34. Both the fixed racks 28 and the movable racks 29 are of substantially similar construction except that the movable racks have means associated therewith as will be hereinafter explained to allow for sideways movement of the racks 29. It is recognized and anticipated that the base frame 37 can be attached or otherwise joined to the upright post members 33 and 34 in any known manner and it is recognized and anticipated that the individual members or components forming the structures 32 and 37 can be of any cross-sectional shape.

Figure 3:
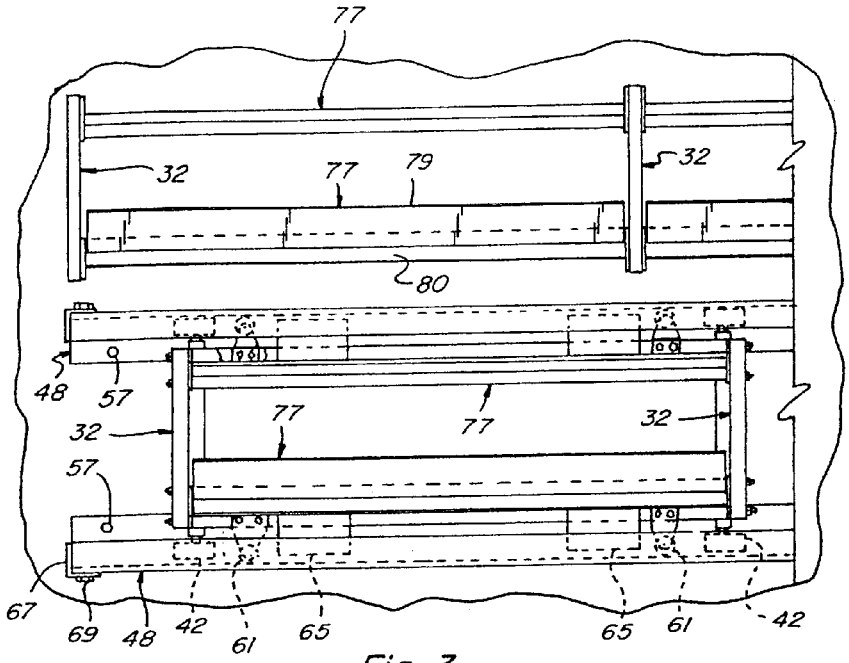
FIG. 3 is an enlarged fragmentary plan view of a fixed rack and a movable rack constructed in accordance with the teachings of the present invention.
Figure 4:
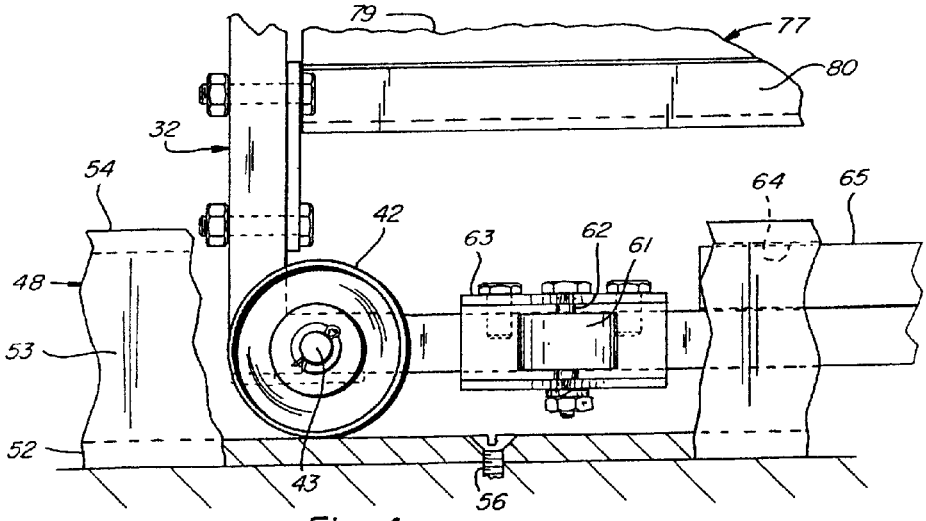
FIG. 4 is an enlarged fragmentary side view of a lower portion of the movable rack of FIG. 3 showing the present support wheels and guide rollers.
Figure 14:
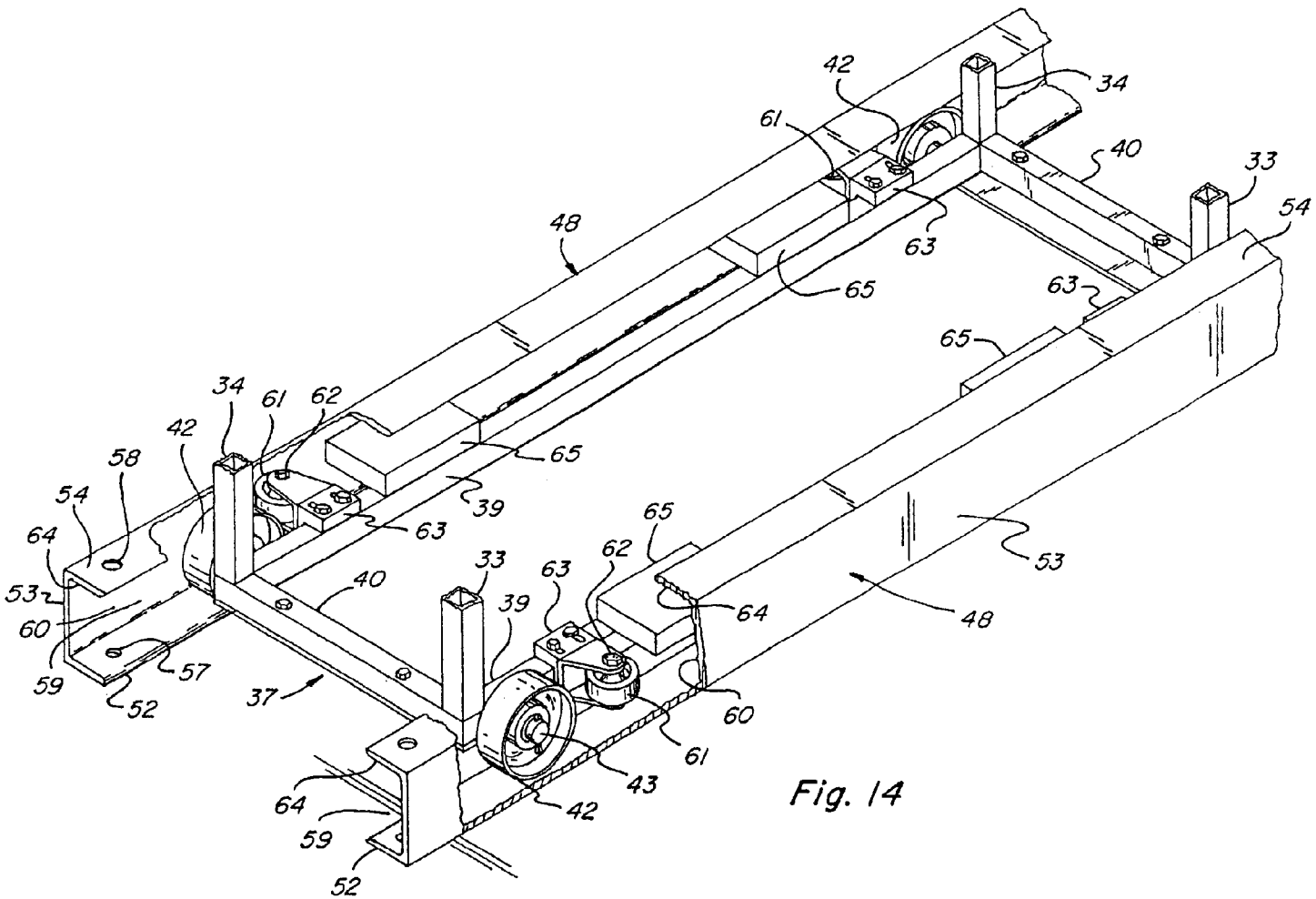
FIG. 14 is an enlarged fragmentary perspective view of the base frame of a rack operatively positioned within the tracks.
Figure 15:
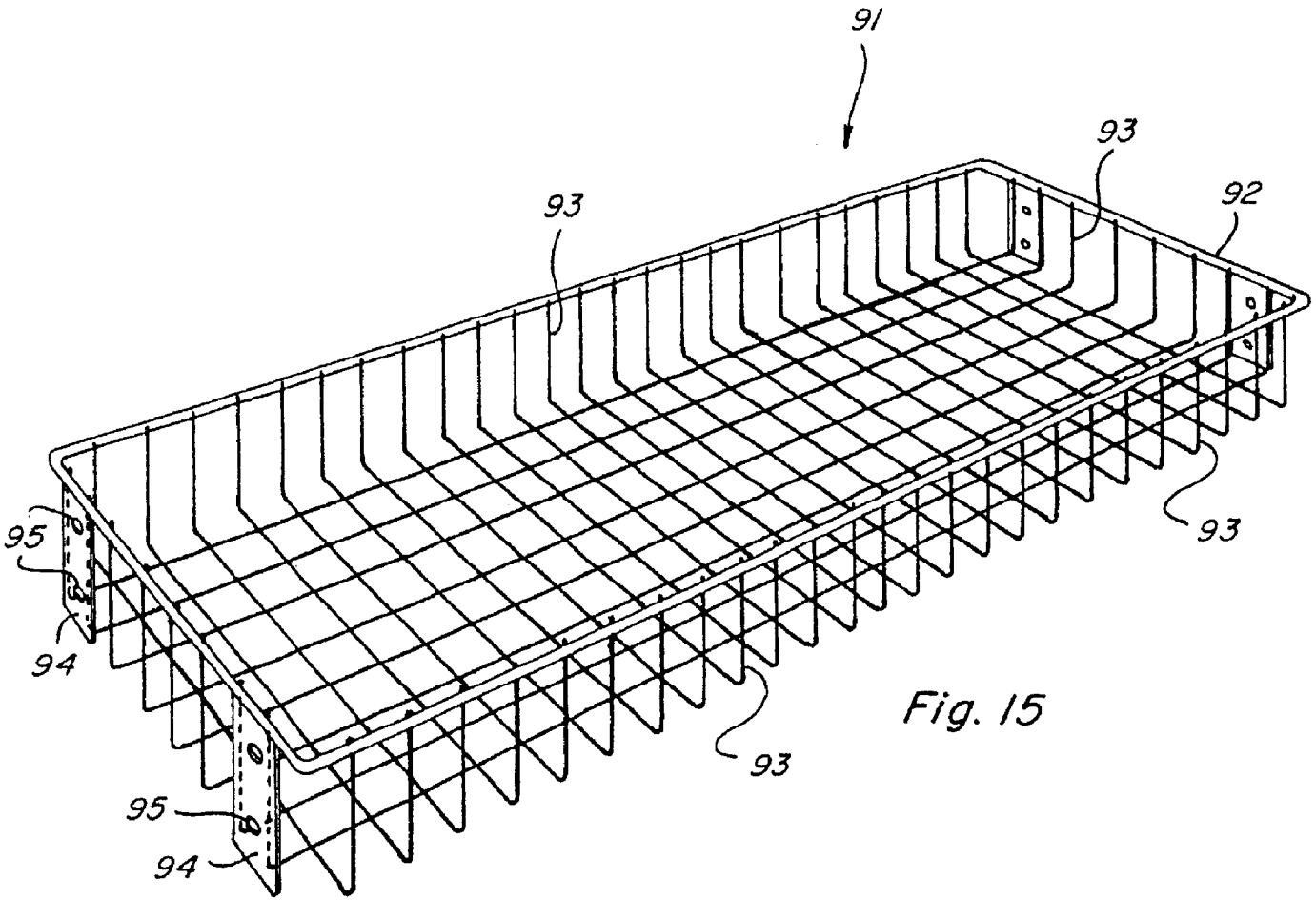
FIG. 15 is an enlarged perspective view of a basket shelf.

As best seen in FIGS. 4 and 14, a wheel 42 is rotatably mounted to each movable rack 29 adjacent each of the four corners thereof. The greater the separation of the wheels, generally, the greater the stability of the overall rack 29 both when stationary and during movement. Each of the wheels 42 is rotatably mounted on an axle 43 which is secured to the base frame 37 as, for example, with brackets 44 and fasteners 45 as best shown in FIGS. 3, 4, 6 and 10. As illustrated, the wheels 42 each rotate on a generally horizontal axle 43 in a generally vertical plane. Preferably, the wheels 42 on each end of the rack, comprising end pairs of wheels, are equally spaced front-to-rear while the wheels on each end of the rack, comprising front and rear pairs of wheels, are equally spaced end-to-end to facilitate their being guided by track members described below. The fixed racks 28 may be simply secured to the floor surface with anchors bolts 46 through the base frame 37 or via other suitable securing means to prevent their movement and tipping.

Figure 10:
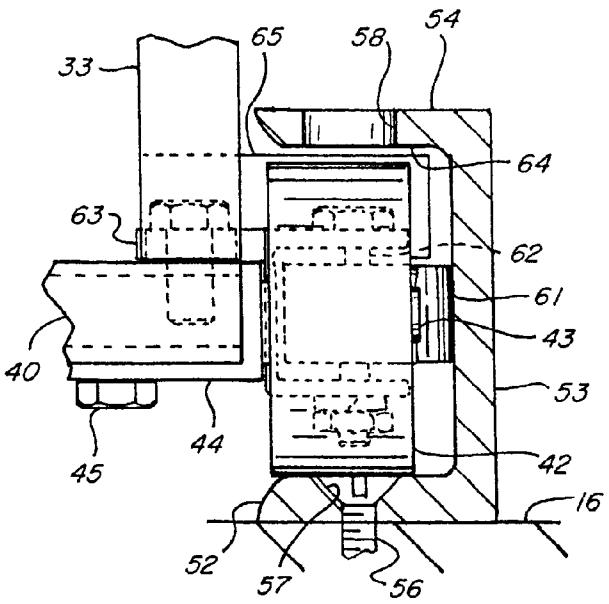
FIG. 10 is an enlarged end view of a wheel and guide roller in a track of the present invention.
Figure 11:
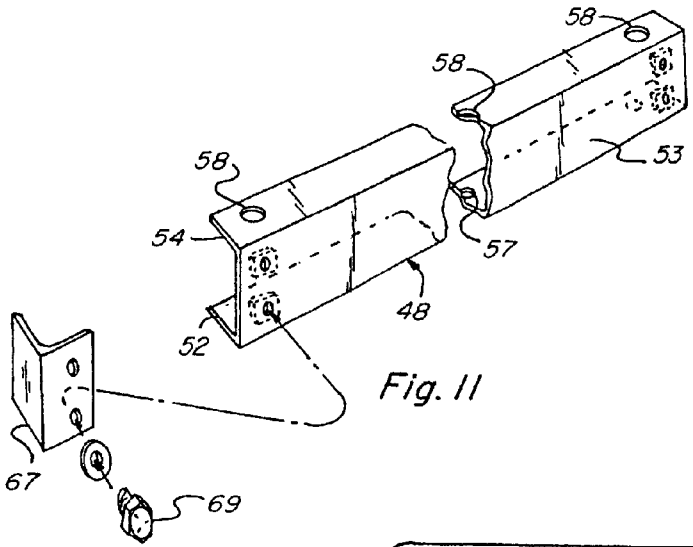
FIG. 11 is an enlarged perspective view of a track illustrating attachment of the stop members adjacent each opposite end of the track.

As best illustrated in FIGS. 2, 3, 4 and 14, floor tracks 48 are provided for receipt of the wheels 42 therein to provide guidance during sideways or lateral (end-to-end) movement of a rack 29 and to help prevent tipping of a rack. In a preferred embodiment, a track 48 captures either the front wheels or rear wheels 42 of a particular rack 29 preferably on three sides of the wheels, namely, the top, bottom, and one side thereof thereby preventing the wheels 42 from leaving their respective track 48. In the illustrated structure, a track 48 is comprised of a substantially U-shaped channel member having a base flange 52, an intermediate web 53, and a top flange 54. The track portions 52, 53 and 54 form closed side portions capturing the wheels 42 on three sides thereof. The track 48 may be made from formed sheet metal or other suitable material. The base flange 52 is adapted to rest on the floor and to be fixedly secured thereto as, for example, with bevel head screws 56 (FIG. 10) which extend through countersunk holes 57 in flange 52, or by any other suitable anchoring means. As illustrated in FIGS. 10, 11 and 14, the base flange 52 and top flange 54 have approximately the same width and apertures 58 would be provided through the top flange 54 to provide access for a fastening tool to extend therethrough to fasten the screws 56 to the floor. Alternately, the base flange 52 can have a width wider than the top flange 54 with the holes 57 located in an area outside of the overhang of the top flange 54 to help facilitate fastening of the screws or other fasteners 56 (FIGS. 3 and 6) to the floor. Each track 48 includes an open side 59 with the open sides of the front and rear tracks opening toward one another. The tracks 48 are secured to the floor and are generally parallel and have a spacing between inside surfaces 60 of the opposed webs 53 preferably larger than the outside spacing of the wheels 42 to provide clearance for the axles 43 and the fasteners securing the wheels thereto.

Guide means are also provided to assist in guiding the movement of a particular rack 29 within the tracks 48 to restrain cocking or tilting of a rack within a pair of tracks 48, that is, front-to-rear and/or rear-to-front movement of a rack within the tracks. As shown in FIGS. 4, 10 and 14, a plurality of guide rollers 61 are mounted on the base frame 37 projecting to the front or rear thereof for engagement with an inside surface 60 of a respective web 53. As shown, there is a guide roller 61 adjacent each of the wheels 42. The guide rollers 61 are mounted about a generally vertically oriented axle 62 for rotation in a generally horizontal plane. Each of the guide rollers 61 and respective axles 62 are mounted on a positionally adjustable bracket 63 that allows the front-to-rear position of a guide roller 61 to be adjusted to ensure proper spacing of the guide rollers for engagement with the respective webs 53. The front-to-rear spacing is also adequate to prevent contact of the axles 43 and wheels 42 with the inside surface 60 of the webs 53.

When a particular rack 29 is engaged with a pair of tracks 48, the wheels 42 are positioned between the flanges 52 and 54 and are therefore restrained against vertical movement thus helping to prevent the tipping of a particular rack 29. In one embodiment, supplemental anti-tip devices may be provided. Anti-tip devices may be required when the rack height to depth ratio exceeds 3:1 in some earthquake prone areas and 4:1 in other areas. As best seen in FIGS. 4, 10 and 14, a plate 65 is secured to the base frame 37 adjacent each of the four corners thereof. The plates 65 have an upper surface that is positioned just below the downward facing surface 64 of the top flange 54. In the event a rack starts to tip, the plates 65 will engage the top flange surface 64 and prevent tipping of the rack. The plates 65 may also prevent objects or debris from falling into the tracks 48.

Stop members 67 are secured to the tracks 48 adjacent each of the open ends thereof as best shown in FIGS. 3 and 11. Preferably the stop members 67 are removably secured to the opposite ends of each track 48 to allow for maintenance of unit and to simplify placement of a particular rack 29 within the tracks after the tracks 48 are secured to the floor. In this regard, it is recognized that any number of movable racks 29 may be positioned within a pair of tracks 48 depending upon the length of the tracks 48. As illustrated in FIGS. 3 and 11, the stop members 67 are L-shaped brackets secured to a respective web 53 with suitable fasteners such as the fasteners 69.

The fixed racks 28 are positioned in a cooler or other product storage area to the rear of the movable racks 29 as best shown in FIGS. 1 and 2. Sideways or lateral movement of a movable rack 29 allows access to a rack located therebehind, whether that rack be another movable rack 29 or a fixed rack 28. In practice, there may be a plurality of rows of movable racks each providing access to any rack, fixed or movable, therebehind. For example, if there are three rows of storage racks, the front two rows would be movable racks. Movement of a rack in the front row provides access to a movable rack in the middle row and if access is needed to a rear rack, racks in both the front and middle rows may be moved. Thus, floor space in a walk-in display cooler or other product storage area can be effectively utilized for storage of products which can be stored in a manner to allow a first-in/first-out inventory control method.

Figure 7:
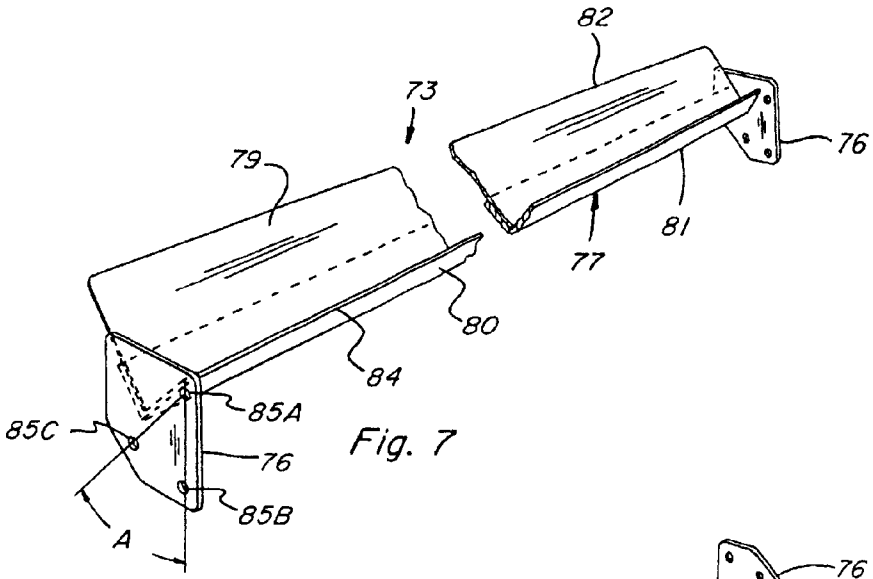
FIG. 7 is a perspective view of a shelf support member positioned in an orientation to provide either an inclined support surface with an upturned lip or a horizontal edge support surface.
Figure 8:
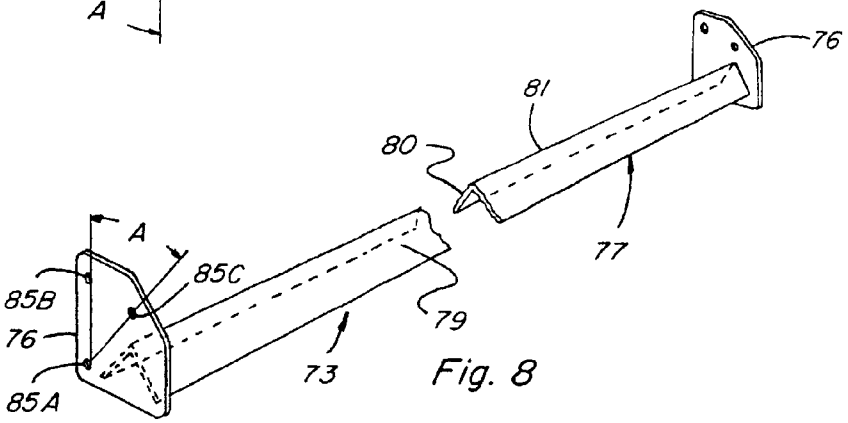
FIG. 8 is a perspective view of a shelf support member positioned in an orientation to provide either an inclined support surface with a downturned lip or a horizontal edge support surface.

The racks 28 and 29 of the present invention are provided with shelving units of various types that can be positioned at various positions and angles relative to the horizontal to enhance the flexibility and use of the present rack system. FIGS. 2, 5, 6 and 9 illustrate the use of one embodiment of a product holding tray or container 72 used in conjunction with a plurality of front and rear shelf support members 73 to achieve different angular orientations. The trays or containers 72 provide support for the product such as soft drink or other beverage products and are fully supported by the front and rear shelf support members 73. As illustrated, the front and rear shelf support members 73 (FIGS. 7 and 8) are separately attached to the corresponding upright posts 33 and 34 in one of several orientations as will be hereinafter further explained so as to achieve either a substantially horizontal planar orientation for the tray or container 72 as illustrated in FIG. 5, or to achieve one of several inclined planar orientations as illustrated in FIGS. 6 and 9. Preferably, the front and rear shelf support members 73 are of similar construction and can be used interchangeably. In one embodiment, the shelf support member 73 includes a pair of end brackets 76 with a support member or flange 77 secured to and extending therebetween. Preferably the end brackets 76 are of like construction so that a shelf support member 73 may be used in a left-right or right-left orientation to increase the versatility of the overall rack system as described below. As best illustrated in FIGS. 7 and 8, the support member or flange 77 is preferably an angle member comprising two flange portions, one flange portion forming the first component 79 and the second flange portion forming the second component 80. Either flange portion 79 or 80 may engage a container floor or the front or rear portion of a particular container 72 depending upon the orientation of the front and rear shelf support members 73 as best seen in FIGS. 2, 5, 6 and 9. For example, in the orientation illustrated in FIG. 6, the front shelf support member 73 is mounted between the opposed front posts 33 of a pair of upright support structures 32 so as to orient the flange portion 80 (FIG. 7) as a generally upturned lip which will engage the front portion of a product holding tray or container 72 to prevent the tray or container 72 from sliding forward out of the rack 28 or 29. In this orientation, the flange portion 80 serves as a stop member while flange portion 79 engages the bottom surface of the tray or container 72 and serves as a support surface for holding the forward portion of the tray or container 72 positioned thereon. In contrast, the rear shelf support member 73 is mounted between the opposed rear posts 34 of a pair of upright support structures 32 in spaced apart relationship above the corresponding front shelf support member 73 so as to orient the flange portion 79 (FIG. 8) to engage the bottom surface of the container 72 while the other flange portion 80 is oriented in a generally downturned orientation to prevent interference with the tray or container 72. This orientation is shown in FIGS. 6 and 8. In this particular arrangement of shelf support members 73, the front and rear shelf support members are positioned such that when a container or tray 72 is positioned thereupon as illustrated in FIG. 6, the tray or container 72 is oriented at an angle say, for example, 45° from the horizontal allowing enhanced access to the contents of the container 72. This orientation also provides for a gravity feed arrangement if the product stored in the container 72 are beverage type products wherein remaining product will slide downwardly and forward when a lead product is removed therefrom.

FIG. 5 shows another configuration wherein the front and rear shelf support members 73 are oriented relative to the upright posts 33 and 34 so as to form a generally horizontal support surface providing two flange portions 79 for engaging the bottom surface of a container 72 whereas the flange portions 80 are downturned to prevent interference with the container 72. A horizontal support surface or plane can also be provided by orienting the front and rear shelf support members 73 relative to the upright posts 33 and 34 in positions similar to FIGS. 7 and/or 8 such that the bottom surface of the tray or container 72 will engage either the apex 81 (FIG. 8) of the support flange 77 formed by the intersection of the flange portions 79 and 80, or the edge portions 82 and 84 of the support flange 77 (FIG. 7). As a result, in combination, the front and rear shelf support members 73 may be oriented with two upturned flange portions 79 and 80, two downturned flange portions 79 and 80, one flange portion 79 or 80 on the front shelf support member 73 being upturned and one flange portion 79 or 80 on the rear shelf support member 73 being downturned, or one flange portion 79 or 80 on the rear shelf support member 73 being upturned while the front shelf support member 73 has a horizontal flange portion and a downturned flange portion. FIG. 9 represents an orientation wherein the front shelf support member 73 has an upturned flange portion and the rear shelf support member 73 has a downturned flange portion. Such versatility provides for a variety of different tray or container orientations depending upon the positioning of the front and rear shelf support member 73 relative to each other and relative to the upright posts 33 and 34, any one or more of which are easily adaptable to the particular product and container 72 being stored.

In order to provide the aforementioned orientations of the flange portions 79 and 80, the end brackets 76 and the upright support structures 32 are provided with cooperating attachment elements to selectively secure the shelf support members 73 in their various orientations simply and easily. A preferred embodiment of attachment elements is illustrated in FIGS. 6 and 7. In this regard, the front and back posts 33 and 34 are each provided with a plurality of spaced apart apertures 83 along the length thereof. Any suitable spacing and number of apertures 83 may be provided depending upon the versatility desired for a particular rack and the number of shelf positions desired in a rack. As seen, the apertures 83 are positioned in a line along respective upright posts 33 and 34 and are formed in pairs, each pair of apertures 83 being spaced apart a distance corresponding to the spacing of apertures 85 associated with the end brackets 76.

Figure 12:
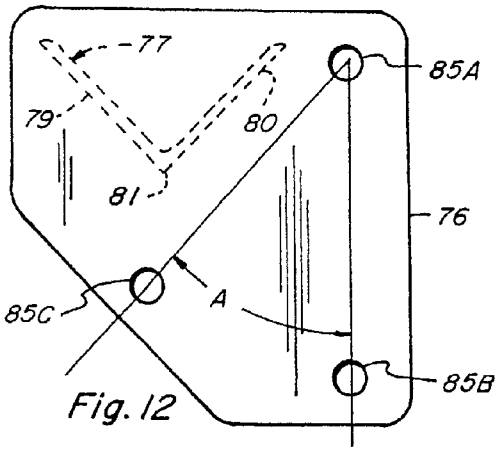
FIG. 12 is an enlarged end view of a shelf support member oriented similar to the shelf support member of FIG. 7.

The brackets 76 are generally in the form of a plate having a plurality of apertures 85 therethrough. A support flange or element 77 is secured to and extends between inside faces of the bracket 76. Preferably the brackets 76 and support flange 77 are metal and are welded together when heavy loads are contemplated. The apertures 85 extend through the bracket 76 each with a longitudinal axis generally parallel to the longitudinal axis of the support flange 77. The length of a shelf support member 73 is generally the same as the spacing between the inside surfaces of the upright support structures 32. The apertures 85 are arranged in a pattern to provide various orientations of mounting as described above. One particularly advantageous pattern of apertures 85 is best seen in FIGS. 6–8. This pattern utilizes three apertures 85 forming two sets of apertures with the apertures of each set having a spacing substantially equal to the spacing between the pairs of apertures 83 associated with each of the posts 33 and 34. As illustrated in FIGS. 7, 8 and 12, the aperture 85A forms a pair with aperture 85B and another pair with aperture 85C, the aperture 85A being at an apex of an angle A formed between the two pairs of apertures. Preferably the angle A between the three apertures is in the range of between about 30° through about 60° and preferably about 45°, however, other angles or multiple angles (using additional apertures) may be utilized depending upon the particular arrangement of shelf support members desired.

In one mounting position, as illustrated in FIG. 9, fasteners 87, such as bolts and nuts, are placed through the apertures 85A and 85B, which positions the shelf support member 73 for use as a front shelf support member 73 with an upturned lip or flange portion 79 to hold and stop the trays or containers 72 from sliding out of the unit. By utilizing the apertures 85A and 85C, the flange portion 80 is substantially vertical and extends upwardly, while the flange portion 79 is generally horizontal extending forward or rearward. By reversing the ends or brackets 76 (left-to-right) associated with the shelf support member 73, the flange portion 80 would now be downturned and generally vertical, while the flange portion 79 would remain generally horizontal. By reversing the ends (left-to-right), inverting the shelf support member 73, and utilizing the apertures 85A and 85B, the shelf support member 73 may be used as a rear shelf support member 73 whereby the flange portion 79 would provide support for the product container. Such a configuration is seen in FIGS. 5 and 9. In the specific shelf support member 73 illustrated in FIGS. 7, 8 and 12, the flange portion 80 is generally parallel to a line between the centers of the apertures 85A, 85C and the flange portion 79 is generally perpendicular thereto. The front and rear shelf support members 73 secure and hold the upright support structures 32 together.

Figure 13:
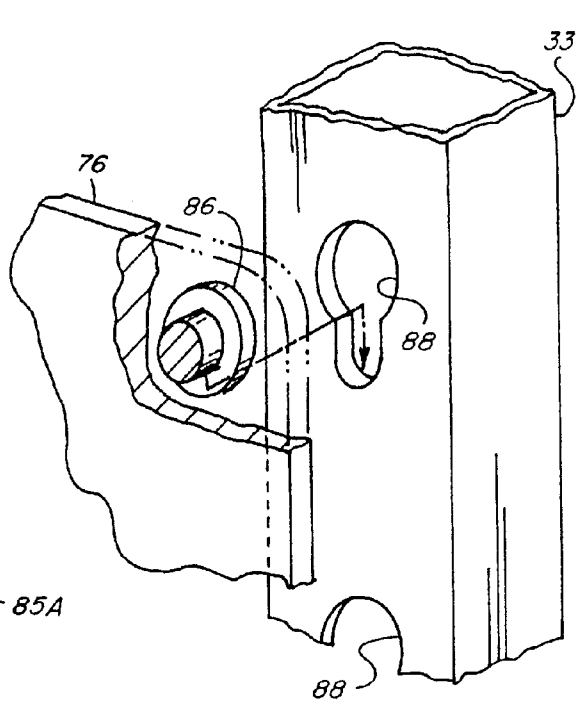
FIG. 13 is an enlarged fragmentary perspective view of an alternate way to attach a shelf support member to an upright support structure.

Alternate attachment elements for the shelf support members 73 may be provided. For example, a T-headed stud 86 as illustrated in FIG. 13 may be secured to either the bracket 76 or the posts 33 and 34, and the other corresponding member (bracket 76 or posts 33 and 34) may be provided with key slots 88 to eliminate the need for the use of separate fasteners such as the fasteners 87. Such fastening devices are commonly used on bed frames and the like and are well known in the art. The positions of the studs 86 and the slots 88 can be similar to the positions of the apertures 83 and 85.

FIGS. 2 and 11 illustrate a basket-type shelf arrangement designated generally 91. The basket 91 is formed by a plurality of interconnected wires 93 forming a floor and four upstanding walls. A top frame member 92 is also provided securing the upper portions of the wires 93 around the periphery of the side walls. Attachment brackets 94 are secured to opposite ends of the basket 91 and have apertures 95 for the receipt of fasteners therethrough such as the fasteners 87 to secure the basket 91 to the posts 33 and 34 associated with the upright support structures 32. Appropriately spaced and positioned apertures 95 would permit mounting the basket 91 either horizontally or at an angle, depending upon the position and location of the attachment brackets 94 and the apertures 95. The basket 91 would be advantageous for the storage of small packaged items such as candy bars, ice cream, small food items and the like.

As best seen in FIGS. 2 and 6, a rack 28 or 29 could be provided with one or more modules 96 having indicia thereon indicative of a "use-by" date or other appropriate date by which the product stored in the rack at that particular location should be sold or distributed. Module 96 can include a mechanism for setting a date through the use of a plurality of numbered wheels or rollers, or alternatively, a surface could be provided on which a date could be written and subsequently erased, if desired. This "use-by" identification system will facilitate the first-in/first-out re-stocking mode of operation.

Figure 16:
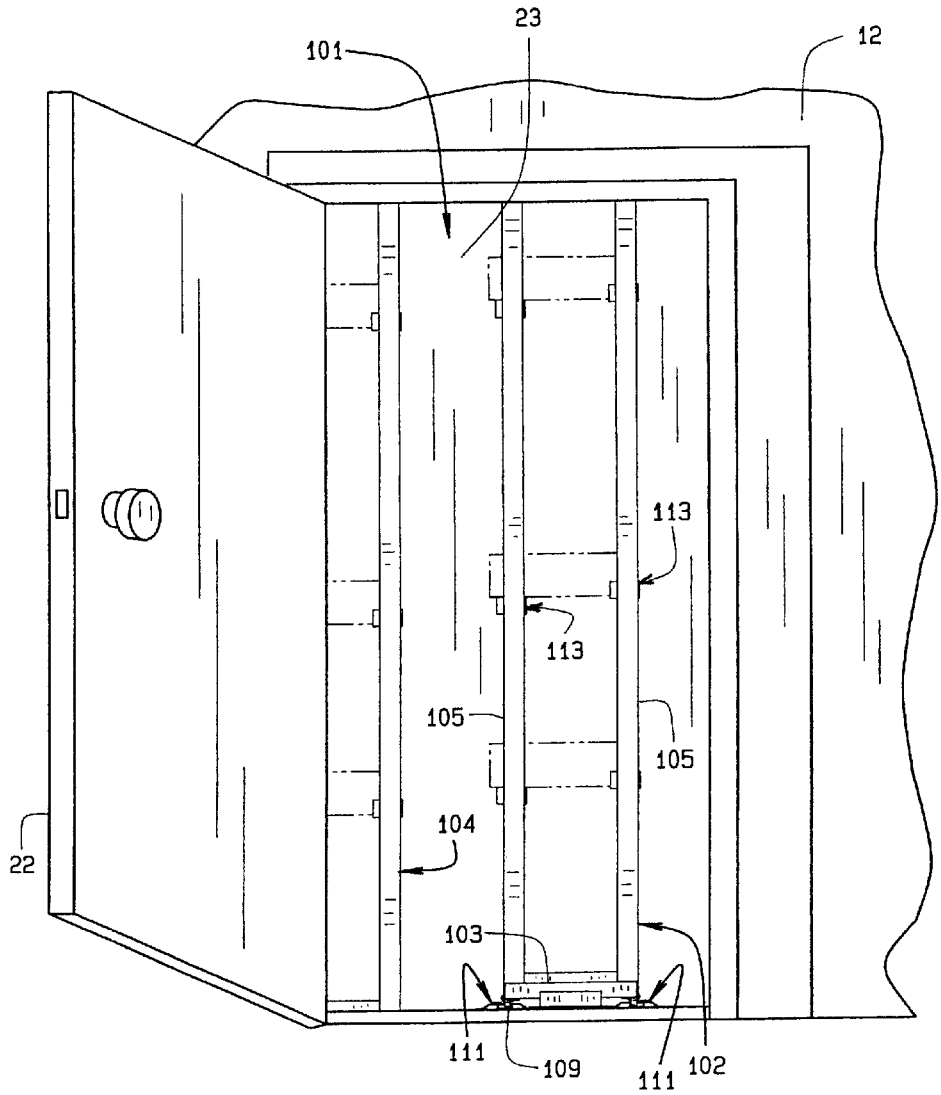
FIG. 16 is an end view of an alternative embodiment of the present product storage system.
Figure 17:
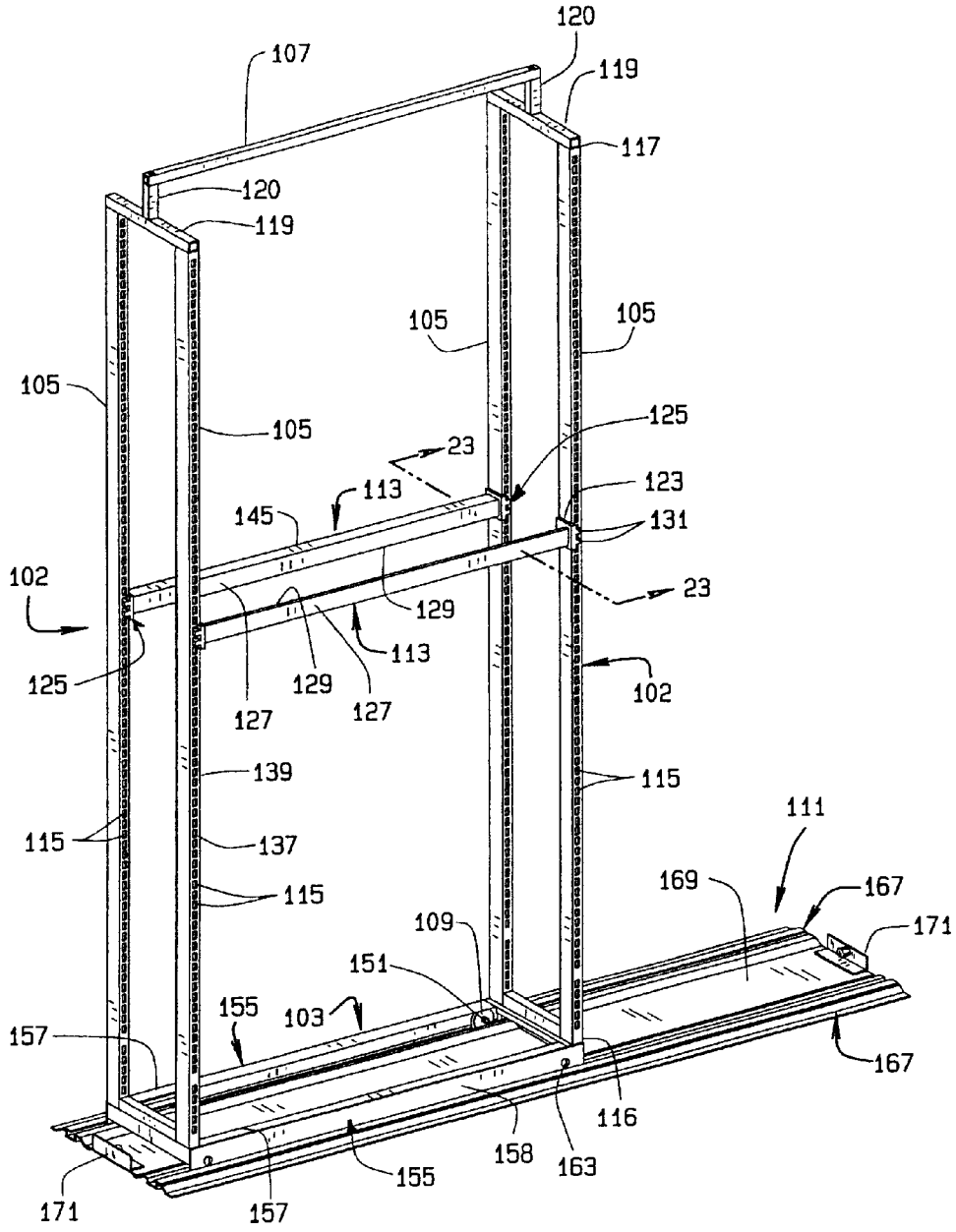
FIG. 17 is a perspective view of the alternate embodiment of the present product storage system.

FIGS. 16–25 illustrate an alternative embodiment 101 of the present product storage system which includes a fixed rack 104, a movable rack 102 having a base frame 103 associated therewith, a plurality of upright shelf support posts or columns 105, and a top brace member 107 (FIG. 17). The construction of racks 102 and 104 is generally similar to that of the racks 28 and 29 described above. The rack 102 is shown as being a movable rack (like rack 29) and includes a plurality of wheels 109 (FIGS. 18, 20, 24) secured to and supporting the base frame 103. The wheels 109 ride in a track unit, designated generally 111, for guiding and restricting movement of the rack 102. The rack 102 further includes a plurality of shelf support members 113 (FIGS. 17, 21, 22) removably mountable to the posts or columns 105 for supporting products generally in the manner described above with regard to shelf support members 73.

The base frame 103 is preferably made of square or rectangular metal tubing as, for example, steel tubing. The posts or uprights 105 are likewise preferably made of square or rectangular metal tubing, with each upright support 105 having a plurality of spaced apart generally rectangular openings 115 associated with the front face thereof as best shown in FIG. 17. The openings 115 in each upright support 105 are in an aligned row with the row of openings 115 extending generally from the bottom end 116 of an upright support 105 to the top end 117. Each of the racks 102 and 104 are shown as including four rows of openings 115, one row of openings in each upright support or post 105. The plurality of openings 115 provide for adjustability in vertically positioning the support members 113. End braces 119 in combination with the brace 107 retain the upper ends of the uprights or posts 105 in fixed spaced relation relative to each other. The two end braces 119 extend between and are secured to two respective uprights 105 and the cross brace 107 extends between and is secured to the end braces 119 via a riser portion 120. Preferably, the cross and end braces 107 and 119 are likewise made of metal tubing for convenience of manufacture. Other bracing arrangements and configurations for rigidifying and stabilizing the rack 102 are likewise recognized and anticipated.

The rack 104 is constructed substantially similar to rack 102, or rack 104 could be constructed substantially similar to fixed rack 28 except that rack 28 would be modified to include the openings 115 on the front face of the upright posts 33 and 34. Other constructions for fixed rack 104 are likewise recognized and anticipated.

Figure 18:
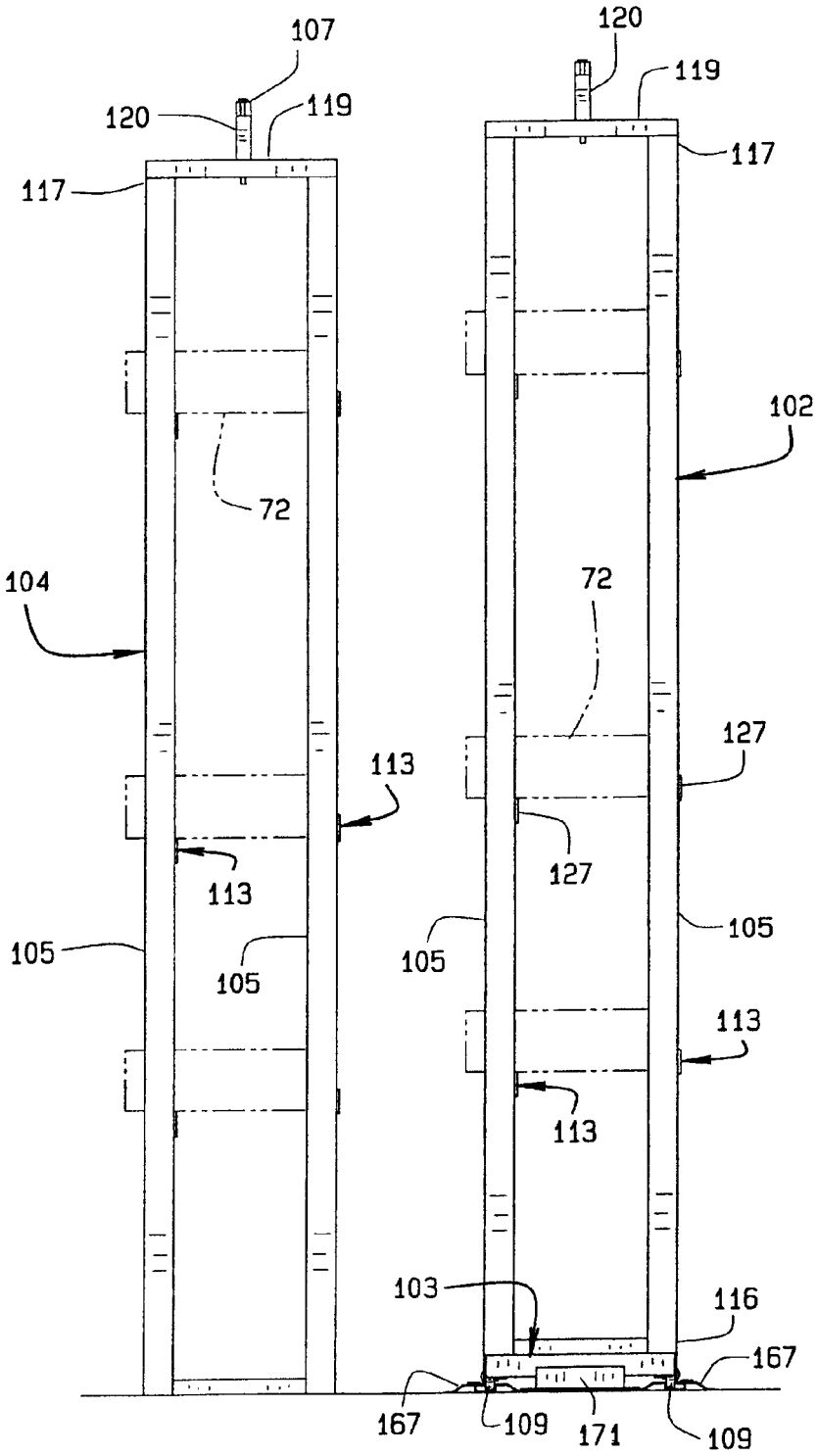
FIG. 18 is an end view showing a fixed rack and a movable rack associated with the alternative embodiment of the present product storage system.
Figure 19:
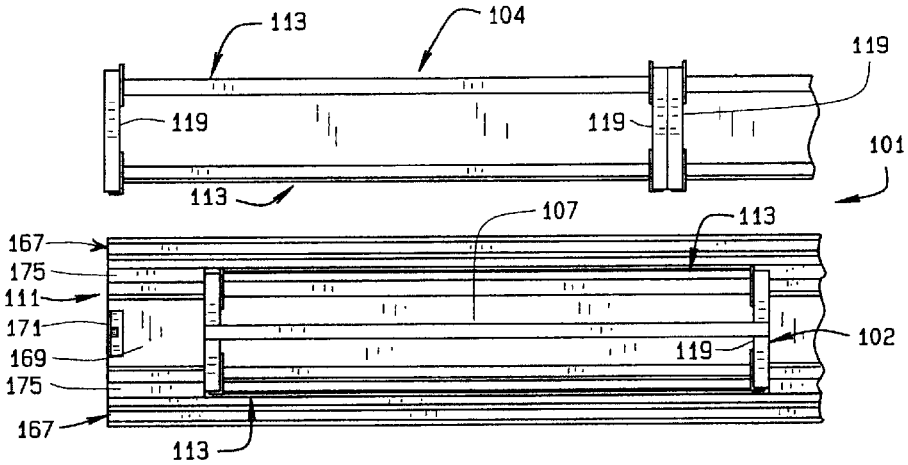
FIG. 19 is a plan view showing a fixed rack (top portion) and a movable rack (bottom portion) constructed in accordance with the teachings of the alternative embodiment of the present product storage system.
Figure 21:
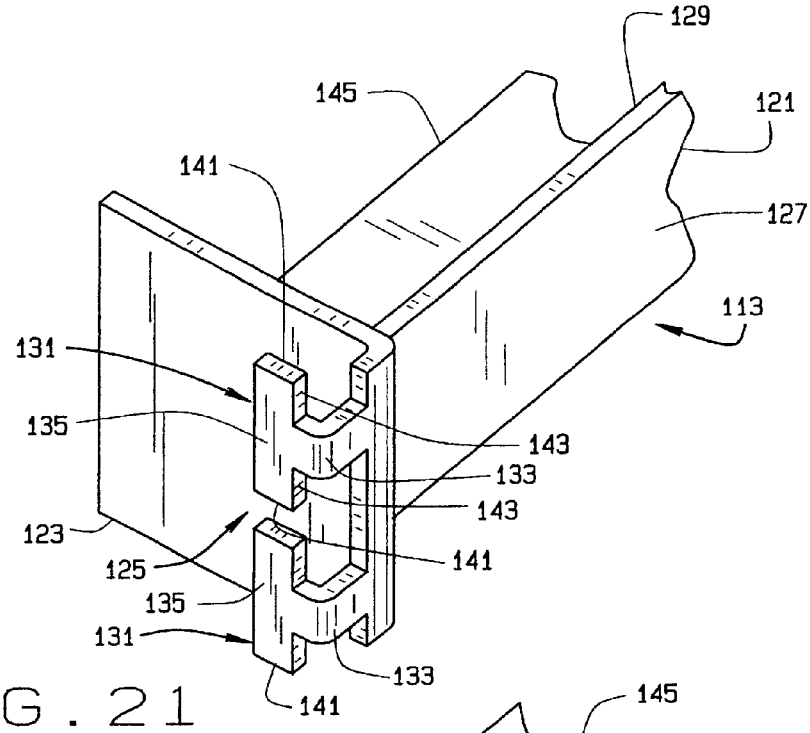
FIG. 21 is an enlarged fragmentary perspective view of an alternative embodiment of a shelf support member showing a front lip in an upturned position.
Figure 22:
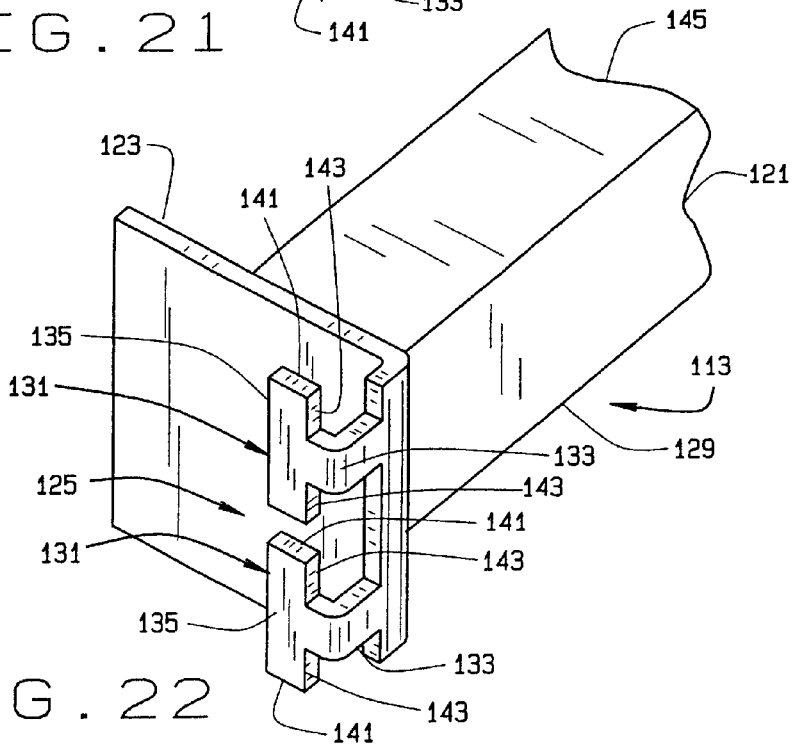
FIG. 22 is an enlarged fragmentary perspective view of the shelf support member of FIG. 21 positioned to show a front lip in a downturned position.
Figure 23:
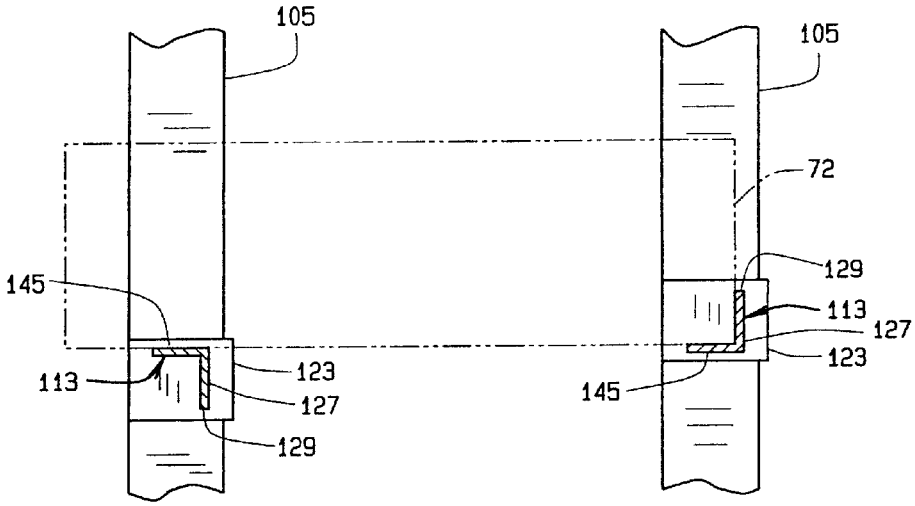
FIG. 23 is a section view taken along line 23—23 of FIG. 17.
Figure 24:
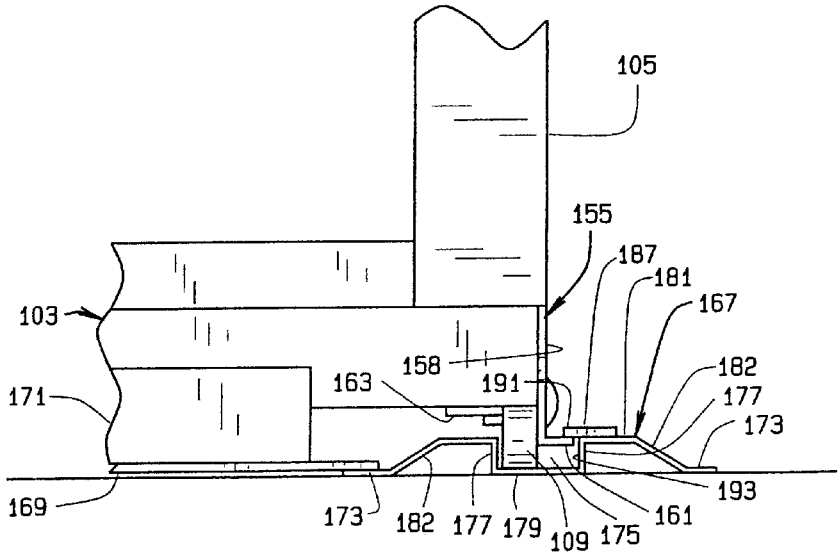
FIG. 24 is an enlarged fragmentary end view showing details of the wheel and track arrangement associated with the alternative embodiment of the present product storage system.
Figure 25:
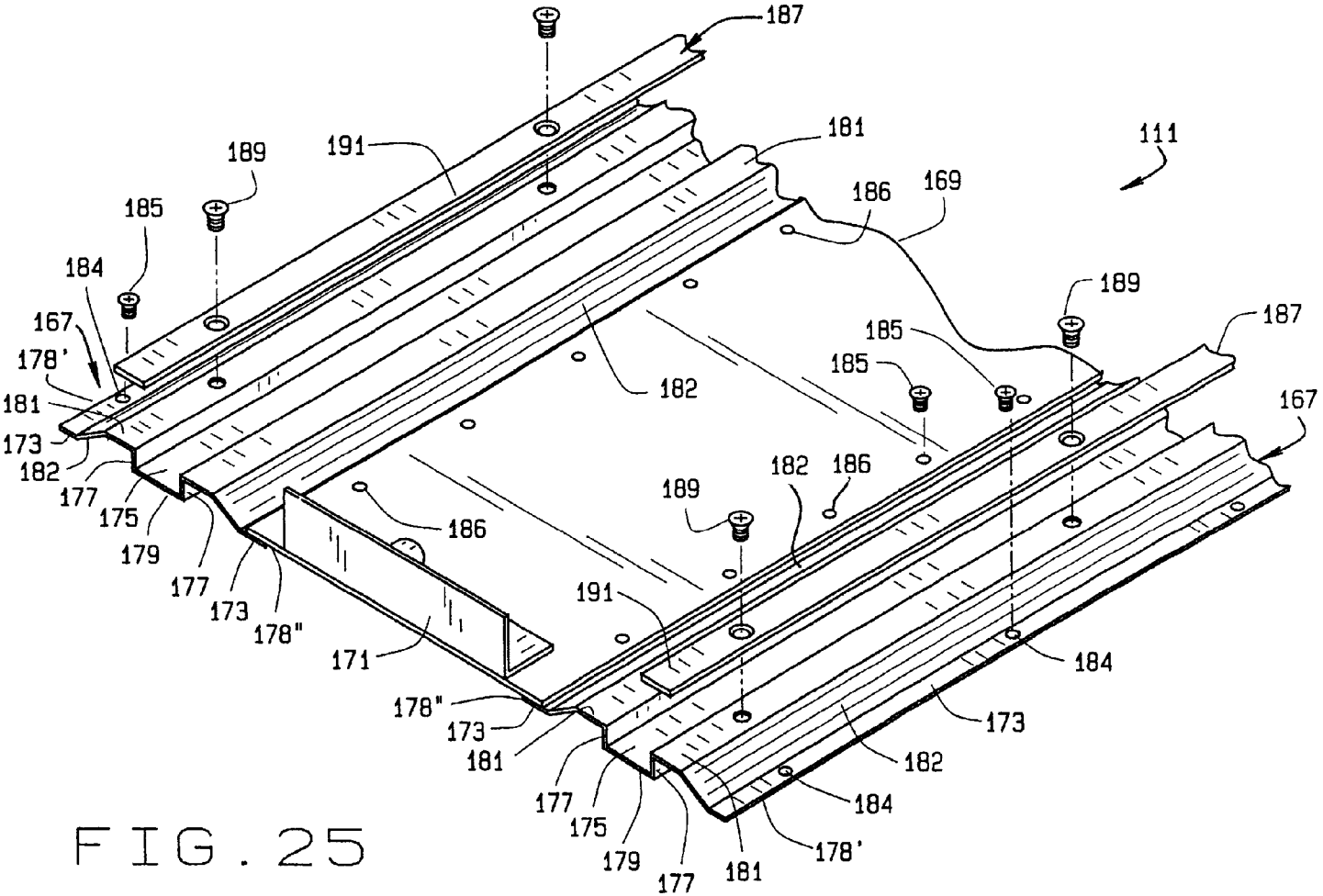
FIG. 25 is an enlarged fragmentary perspective view showing details of a track assembly with a pair of tracks constructed in accordance with the teachings of the alternative embodiment of the present product storage system.

A plurality of shelf support members 113 (FIGS. 17, 18) are removably mountable onto the uprights or posts 105. In the illustrated structure, each shelf support member 113 includes an elongated angle member or support flange 121 (FIGS. 17, 22, 23) having flange portions 127 and 145. A plate member 123 is secured to each opposite end of angle member 121, for example, by welding. Attachment members 125 as will be hereinafter further explained are provided on each shelf support member 113 for cooperating with corresponding attachment members, namely, the openings associated with the front face of each upright support or post 105. The attachment members 125 enable the shelf support members 113 to be removably secured to the upright support posts 105 in any one of a plurality of vertically spaced locations along the length of the upright posts 105. In a preferred embodiment, the attachment members 125 and 105 are such so as to permit reconfiguration of the shelf support members 113 to provide for a plurality of mounting positions as best shown in FIGS. 17, 18 and 23. In the illustrated structure, the attachment devices 125 and 105 are such so as to permit switching from a right hand mount to a left hand mount and vice versa similar to the multi-position mounting of the shelf support members 73 described above with respect to FIGS. 6–9. By switching ends from left to right or right to left, the angle member 121 may open generally upwardly or downwardly. Reconfiguration is done by rotating a shelf support member 113 180° about its centerpoint. When opening upwardly, a lip 129 is formed which can limit movement of product either forward, rearward or both depending on which of the shelf support members 113 has an upstanding lip 129. In FIG. 17, the front shelf support member 113 has an upturned lip 129 and the rear shelf support 113 has a downturned lip 129 (FIG. 23). This orientation of the support members is also illustrated in FIG. 23 wherein the flange portion 145 associated with the rear support member 113 is positioned to engage the floor of a typical product holding tray or container 22 whereas the flange portion 127 of the front support member 113 is oriented with lip 129 in an upward orientation such that flange 127 will engage the front portion of container 72 as illustrated to prevent the container 72 from sliding forward out of the rack 102 or 104. In this orientation, the front flange 127 serves a stop member while flange 145 serves as a support surface for holding the forward portion of the container 72 positioned thereon. In contrast, the rear shelf support member 113 is mounted between the opposed rear posts 105 so as to orient the flange 145 to engage the bottom surface of the container 72 while the flange 127 is oriented in a generally downturned orientation to prevent interference with the container 72. As best shown in FIGS. 17, 21 and 22, regardless of how the shelf support members are oriented, attachment members 125 will always be positioned and oriented at the respective opposite ends of the members 113 as illustrated in FIGS. 21 and 22 to engage the openings 115 of the respective support posts 105. With appropriate cooperative attachment members, the shelf support members 113 versatility in use similar to that described for the rack system disclosed above in FIGS. 1–15 associated with the first embodiment of the invention.

In the embodiment illustrated in FIGS. 21 and 22, attachment members 125 include at least one catch member 131 associated with each opposite end of a shelf support 113, each catch 131 including a web 133 which may be integrally formed with the plate 123 and an ear portion 135 extending from the web 133. The ear 135 is spaced from the plate a distance approximately equal to the spacing between an inside edge 137 of the opening 115 and an inside face 139 of an upright support post 105 as best shown in FIG. 17. In the embodiment illustrated in FIG. 17, the openings 115 are preferably elongated slots for receiving the ear portions 135 of the end catch members 131. In this regard, each ear 135 has a pair of oppositely extending projections 141 with shoulders 143. The ears 135 will each fit through a respective opening or slot 115 and-at least one of the shoulders 143 will engage the inside surface of the upright support post 105 adjacent a respective opening 115 to secure a shelf support member 113 in place on a respective pair of upright support posts 115. The presence of opposing projections 141 permits each shelf support member 113 to be positioned and oriented as described above to achieve the orientations illustrated in FIGS. 21 and 22. A pair of shelf support members 113, one being mounted between a pair of rear upright posts 105 and one being mounted between a pair of front upright posts 105, cooperate to form a platform for supporting product holding containers such as the containers 72 as previously described. A pair of shelf support members 113 for supporting the containers 72 or other product holding trays or shelves may be positioned at equal heights on the front and rear upright posts 105 as illustrated in FIG. 18 to achieve a substantially horizontal support surface or platform, or a pair of shelf support members 113 may be offset vertically preferably with the front shelf support member 113 being lower than the rear shelf support member 113 to provide an inclined platform for gravity feed purposes similar to that described above with respect to shelf support members 73 and illustrated in FIG. 6.

In the illustrated structure, as best seen in FIGS. 16–18, a rack 102 is movable laterally on a track unit 111 via a plurality of wheels 109 rotatably carried by the 103. As shown, the wheels 109 are mounted on axles 151 (FIG. 17) mounted to frame 103. The frame 103 includes a pair of generally opposed L-shaped members 155 (FIGS. 17, 24) each having a first flange 157 that is generally horizontal to the supporting floor surface and an upstanding flange 158 to which the wheels 109 are rotatably mounted via axles 151. The wheels 109 are secured on the axles 151 with fasteners 163. An axle 151 may be welded to the flange 158 or otherwise suitably secured thereto. In a preferred embodiment, a wheel 109 is mounted adjacent each corner of the base frame 103.

The track unit 111 is provided for guiding and restricting the movement of rack 102 and includes a pair of spaced apart tracks 167 which are maintained in spaced and generally parallel relation, for example, by a spacer strip 169. Stops, designated generally 171 (FIGS. 17, 25) are secured at opposite ends of the track unit 111 to limit the amount of lateral movement of the rack 102. As shown, a stop 171 is secured to the spacer strip 169 in any suitable manner, for example, by welding. The spacer strip 169, in the illustrated structure, is an elongated plate member that is secured to an inside foot 173 of each of the tracks 167 as, for example, by welding. Each track 167 includes an upwardly opening channel 175 formed by two spaced and generally parallel side walls 177 and a bottom wall 179 connected to and extending between the side walls 177. An outwardly extending flange 181 extends from each of the side walls 177 and terminates in an outwardly and downwardly sloping web 182 which terminates in a respective elongated foot 173. Each foot 173 defines a respective longitudinally extending side edge 178' and 178" associated with each track 167. The flange 181, web 182 and foot 173 on each side of the track 167 form a laterally projecting riser. Preferably, each track 167 has each of its component parts 173, 177, 179, 181 and 182 extending longitudinally along substantially the entire length of the track. Such component parts can be integrally formed into a one piece unit and such parts can be fabricated from metal for durability and ease of manufacture. Each track 167 is also generally symmetrical about its longitudinal axis. One or both feet 173 may be provided with apertures 184 through which anchors 185, such as screws, may be extended for securing a track 167 to an underlying floor surface. The opposed side portions of spacer strip 169 likewise include corresponding opening 186 for registering with the openings 184 to secure the spacer strip 169 and the inside foot 173 of each track 167 to the underlying floor surface.

Figure 20:
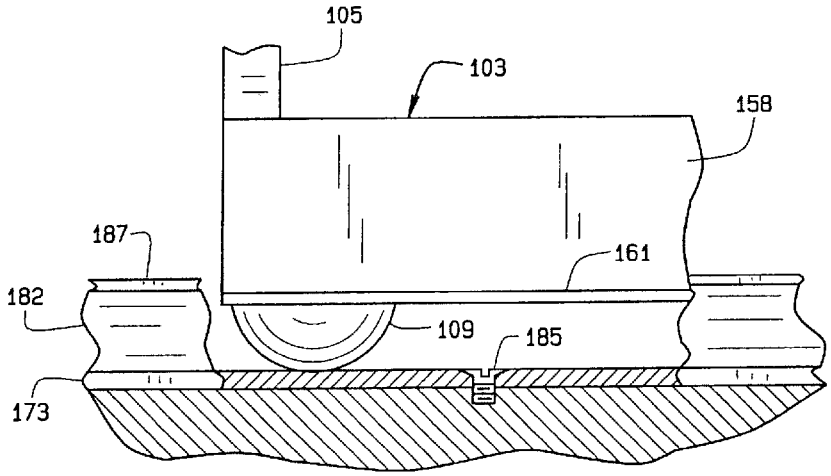
FIG. 20 is an enlarged fragmentary front elevation view of a portion of the movable rack showing details of a wheel and a track associated with the alternative embodiment of the present product storage system.

Each of the tracks 167 includes a hold down member 187 which may be a part separate from the track or, in the alternative, could be formed integral therewith. In the illustrated structure, the hold down member 187 is elongated and extends along the length of a respective track 167. The hold down member 187 is secured to a respective track 167 in any suitable manner such as with screw fasteners 189 that are preferably recessed and flush. An edge margin portion 191 of hold down member 187 extends over the channel 175 forming a side opening groove or overhang space 193, the space or groove 193 preferably opening inwardly of the respective tracks 167 whereby such grooves or spaces open toward one another. The grooves or spaces 193 are each positioned between the respective edges 178' and 178". A flange 161 extends into the space or groove 193 and is positioned and captured between the edge margin 191 and the bottom 179 of the channel 175. The flange 161 can be formed integral with base flange member 155 and can extend from flange portion along either a substantial portion of the length of the flange portion 158 as best shown in FIG. 20, or at one or more spaced positions along the length thereof. The flange 161 could also be part of a separate bracket or L-shaped member which could be attached by suitable means to flange portion 158 at the appropriate locations along the length of member 155. Other structures for achieving flange 161 are likewise envisioned and anticipated. The edge margin 191 and flange 161 form overlapping shoulders that act as a stabilizing mechanism and prevent the rack from tipping or falling over in a front to rear direction. If the load of product associated with rack 102 is distributed such that a forward or rearward moment is created, any tipping or leaning of the rack 102 within the track channels 175 will allow the flange or flanges 161 to engage the edge margin 191 of hold down member 187 thereby limiting the amount of tipping and preventing the rack from falling over.

Although the present product storage and inventory control system has been described with respect to use in a walk-in cooler environment, it is recognized and anticipated that the present system could be utilized in any product storage application where products are stored and held for re-stocking purposes or for other use at a later date. The present system also has utility in other applications such as other storing applications and providing easy access to a wide variety of different goods such as tooling, industrial supplies, and the like.

In view of the foregoing, it will be seen that the several objects of the invention are achieved and other advantages are attained. Although the foregoing includes a description of the best mode contemplated for carrying out the present invention, various modifications are conceivable. As various modifications could be made in the constructions and methods herein described and illustrated without departing from the spirit and scope of the invention, it is intended that all matter contained in the foregoing description or shown in the accompanying drawings shall be interpreted as illustrative rather than limiting.

Other aspects, objects and advantages of the present application can be obtained from a study of the drawings, the disclosure and the appended claims.

What is claimed is:

1. A product storage system comprising:

a rack with at least one shelf for storing product;

a pair of tracks secured to a support surface, said tracks each including a generally upwardly opening channel partially defined by a wheel supporting upwardly facing bottom wall and at least one side wall, each track further including a first flange extending from said at least one side wall away from said respective channel, said first flange being at an elevation above said bottom wall;

a member extending along at least a portion of the length of each respective track, said member having a portion extending over a portion of said channel bottom wall forming a side opening groove in each respective channel;

a plurality of wheels rotatably mounted to said rack adjacent a lower portion thereof for receipt in a respective channel, said wheels and tracks permitting restrained movement of the rack in two directions; and a second flange secured to two opposed sides of said rack adjacent the lower portion thereof, each of said second flanges extending into a side opening groove associated with said track channels and each being positioned between a respective channel bottom wall and said member to limit tipping of the rack in two directions.

2. A product storage system as set forth in claim 1 wherein said member is removably secured to a respective track.

3. A product storage system as set forth in claim 2 wherein the bottom wall of each track channel has a generally flat surface portion in engagement with at least some of said plurality of wheels.

4. A product storage system as set forth in claim 1 wherein each track includes at least one laterally projecting riser extending along the length of the track, said riser having a bottom surface portion adapted to rest on a supporting floor surface.

5. A product storage system as set forth in claim 4 wherein said riser includes a longitudinally extending web portion and a foot portion, said web portion extending upwardly and inwardly from said foot portion towards said first flange.

6. A product storage system as set forth in claim 4 wherein each said track includes a laterally projecting riser on each side of said track channel and wherein a first flange extends outwardly from each side wall forming said respective track channel, and a pair of longitudinally extending web portions and foot portions, each web portion extending inwardly and upwardly from a respective foot portion towards a respective first flange.

7. A product storage system as set forth in claim 1 including a spacer strip extending between and secured to said tracks fixing them in spaced relationship.

8. The product storage system as set forth in claim 1 wherein said rack includes a base frame portion, said plurality of wheels being rotatably mounted to said base frame portion, said second flanges being secured to opposed sides of said base frame portion, one of said second flanges being engagable with a portion of said member extending over one of said track channels and the other of said second flanges being engagable with a portion of said member extending over the other of said track channels to prevent the rack from tipping over in a front to rear direction.

9. An adjustable rack for the storage of products including:

a plurality of spaced apart upright support structures, each of said upright support structures having a plurality of spaced apart openings associated respectively therewith;

at least two shelf support members, each shelf support member having a plate member associated with each opposite end thereof, said plate members each including at least one catch member adapted for cooperative engagement with a selected one of said plurality of spaced apart openings associated with said upright support structures for removably mounting said shelf support members on said upright support structures, at least two of said shelf support members being mountable to said upright support structures to form a product support surface for the storage of products, said shelf support members being mountable at one of a plurality of vertical positions on said upright support structures;

at least one of said shelf support members having said catch members configured and located to permit mounting of said shelf support member selectively at one of at least two different orientations relative to said upright support structures;

a pair of tracks secured to a support surface, said tracks each including a generally upwardly opening channel partially defined by a wheel supporting upwardly facing bottom wall and at least one side wall, each track further including a first flange extending from said at least one side wall away from said respective channel, said first flange being at an elevation above said bottom wall;

a member extending along at least a portion of the length of each respective track, said member having a portion extending over a portion of said channel bottom wall forming a side opening groove in each respective channel;

a plurality of wheels rotatably mounted to said rack adjacent a lower portion thereof for receipt in a respective channel, said wheels and tracks permitting restrained movement of the rack in two directions; and a second flange secured to two opposed sides of said rack adjacent the lower portion thereof, each of said second flanges extending into a side opening groove associated with said track channels and each being positioned between a respective channel bottom wall and said member to limit tipping of the rack in two directions.

10. A product storage rack comprising:

a base frame member having a plurality of wheels rotatably mounted thereto;

a pair of spaced apart upright support structures extending upwardly from said base frame member, each of said upright support structures having a plurality of spaced apart openings extending along the length thereof;

at least two shelf support members, each shelf support member having a plate member associated with each opposite end thereof, said plate members each including at least one catch member adapted for cooperative engagement with a selected one of said plurality of spaced apart openings associated with said upright support structures for removably mounting said shelf support members to said upright support structures, each of said catch members being configured and located to permit mounting of said shelf support members selectively at one of a plurality of different orientations relative to said upright support structures at least two of said shelf support structures being mountable to said upright support structures to form a product support surface;

a pair of tracks secured to a support surface, each of said tracks including a generally upwardly opening channel partially defined by a upwardly facing bottom wall and at least one side wall, each track further including a first flange extending from said at least one side wall away from said respective channel, said first flange being at an elevation above said bottom wall;

a member extending along at least a portion of the length of each respective track, said member having a portion extending over a portion of said channel bottom wall forming an overhang space within each respective channel;

a second flange secured to two opposed sides of said base frame member, each of said second flanges extending into the overhang space associated with each respective track channel between the channel bottom wall and said member;

said plurality of wheels and tracks permitting movement of said pair of upright support structures in two directions when said wheels are engaged with said tracks.

11. The product storage rack as set forth in claim 10 wherein said at least two shelf support members can be selectively mounted to said upright support structures so as to form either a substantially horizontal product support surface or an inclined product support surface.

* * * * *